United States Patent [19]

Ollero-Pina et al.

[11] Patent Number: 4,638,914

[45] Date of Patent: Jan. 27, 1987

[54] FRUIT SELECTING MACHINE

[75] Inventors: Juan C. Ollero-Pina; Antonio Garrido-Diaz, both of Seville, Spain

[73] Assignee: Sociedad Anonima de Racionalizacion y Mechanizacion, Seville, Spain

[21] Appl. No.: 691,931

[22] Filed: Jan. 16, 1985

[30] Foreign Application Priority Data

Aug. 10, 1984 [ES] Spain ..... 281046[U]

[51] Int. Cl.[4] ..... B07C 5/07

[52] U.S. Cl. ..... 209/617; 209/621; 209/666; 209/707; 209/917

[58] Field of Search ..... 209/617, 621, 659, 660, 209/666, 903, 917, 924, 934, 940, 622–624, 707, 910; 198/370, 441

[56] References Cited

U.S. PATENT DOCUMENTS

| | | | |
|---|---|---|---|
| 508,911 | 11/1893 | Billingsley | 209/621 |
| 548,865 | 10/1895 | Clarkson | 209/621 |
| 1,082,632 | 12/1913 | Hastings | 209/617 |
| 1,196,975 | 9/1916 | Pease | 209/621 |
| 2,364,187 | 12/1944 | Birdsall | 209/617 |
| 2,502,906 | 4/1950 | Waters | 209/617 X |
| 2,525,050 | 10/1950 | Spicer et al. | 209/617 |
| 4,379,509 | 4/1983 | Bohle | 209/621 X |

FOREIGN PATENT DOCUMENTS

| | | | |
|---|---|---|---|
| 2279483 | 2/1976 | France | 209/617 |
| 0150640 | 4/1961 | U.S.S.R. | 209/940 |

*Primary Examiner*—Robert B. Reeves
*Assistant Examiner*—Edward M. Wacyra
*Attorney, Agent, or Firm*—Cushman, Darby & Cushman

[57] ABSTRACT

Fruit, which may be oblong fruit such as olives, are mechanically sorted into two separate vessels, depending on whether they are, or are not individually thick enough to be clamped between a reciprocating head and a plate, while the head and plate rotate about a drum axis at a downstream end of a carrying run of an endless conveyor for the fruit. The clamped (oversized) fruit are carried further about the periphery of the drum than are the non-clamped (undersized) fruit, allowing these two classes of fruit to be collected separately. In a preferred embodiment, the fruit are individually deposited on the conveyor and subjected to common orientation before passing between the reciprocating head and the plate.

8 Claims, 5 Drawing Figures

FRUIT SELECTING MACHINE

BACKGROUND OF THE INVENTION

This invention, as stated in the title of this Specification, refers to a fruit selecting machine, specifically, to a machine intended for selecting fruit according to its size.

In principle, the machine which the invention proposes, has been designed for selecting olives, and this description is going to be made in keeping with this, although obviously this machine can also be applied for selecting any other type of fruit by merely varying its dimensional features accordingly.

In fact, there is a great variety of fruit in which it is worth while making a selection according to size, in order to define certain classes or categories. Obviously, one of the features which conditions the price of a given fruit consists of its size. The need also exists, in other cases, of selecting fruit by its size to establish independent groups within which that size moves, within predetermined levels, for subsequent manufacturing processes.

Specifically, in the preferred example of practical application of the machine, corresponding to selecting olives, there are multiple conditioning factors which call for this selection by sizes.

Until now, the selection of olives or other fruit according to their size has been performed manually, with the obvious disadvantages which this entails, both from the point of view of cost and inaccuracy in selecting.

SUMMARY OF THE INVENTION

The machine which the invention proposes enables the selection process to be performed completely automatically, practically without labour and with greater working reliability.

For this, the machine which the invention proposes is made up of a hopper equipped for supplying fruit individually to a drag chain provided with drive means to ensure the correct positioning and spacing of the fruit, which thereby reaches a sizing drum, in line and with a pre-established sequence, in which the fruit is graded into two groups, one upper and the other lower, with respect to a given size, likewise prefixed.

More specifically, in the said sizing drum, to be exact in its periphery, a circumferential alignment of diametrical holes is made, in which two retractile shanks move, driven by a cam integrally joined to the shaft of the actual drum, and displaced in a given turning angle of the drum against a plate, also integrally joined to its shaft, without reaching the said plate and defining the aforementioned level with respect to the latter.

The olives, previously placed in position, with their longest axis parallel to the drum axis, pass between the working front of the respective shank and the support plate, and when their dimension exceeds the predetermined size mentioned above, they are trapped by the retractile shank, being fixed to the drum while it turns a given angle, whereas when their dimensions are less, they remain in a completely free position between the retractile shank and the support plate.

In these conditions, and through the effect of the actual turning of the drum, the olives which are smaller than the predetermined dimension leave the drum at its outlet by centrifugal force, dropping onto the respective collecting vessel with holes, while those whose dimensions are larger than the prefixed size remain adhered to the drum until they pass the aforementioned vessel, at which moment the cam makes the shank retract, thereby releasing the fruit which falls into a second vessel with holes, independent of the previous one.

To avoid the retractile shank damaging the fruit, it has been designed as a hollow cylinder, which shifts telescopically in the drum housing, through the effect of the cam, with a rod moving inside the said hollow cylinder, in whose end corresponding to the plate, the respective operative head is fixed, which has to touch the fruit, while between the said head and the inlet of the hollow cylinder, a spring in turn is fixed, which enables the said head to withdraw easily, when it touches the fruit.

In this way, according to the aim of the invention, the fruit which does not reach the predetermined level leaves on reaching the rotating sizing drum, dragged by the latter and is completely free to be removed by centrifugal force, while that fruit which exceeds the said level adheres to the drum during part of its turning stage, later being released and subsequently removed, after the smaller sized fruit has been ejected, thereby making both independent.

To complete the description being made and in order to assist a better understanding of the features of the invention, a set of drawings is attached to this Specification, as an integral part thereof, in which the following has been shown, with an illustrative and unlimiting nature.

BRIEF DESCRIPTION OF THE DRAWINGS

Finally.

DETAILED DESCRIPTION

Figures 1, 1A:
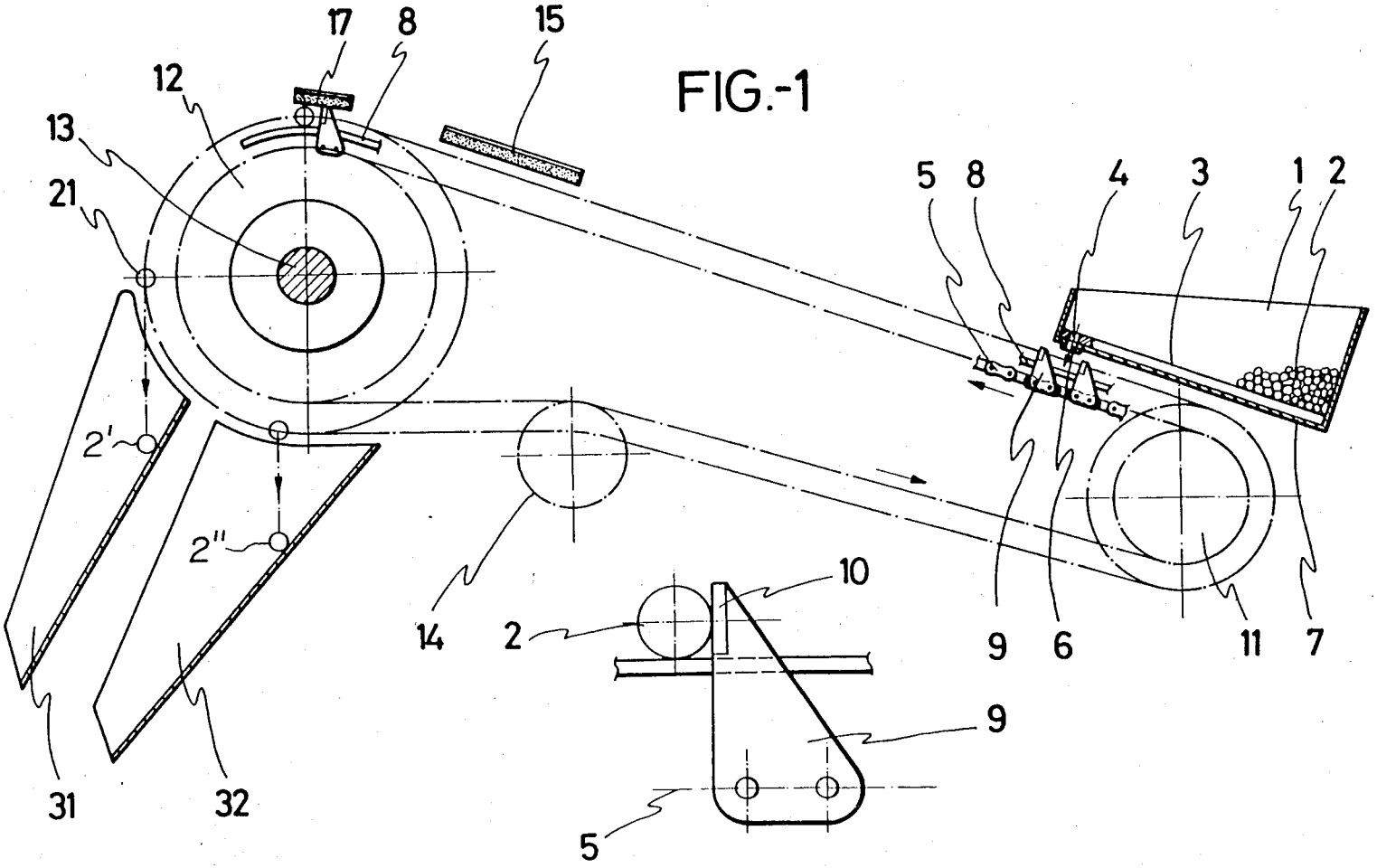
FIG. 1 shows a schematic illustration in a side elevation view of a fruit selecting machine, executed according to the object of this invention.
In FIG. 1A, an enlarged detail has been shown of one of the drag stubs for the fruit, connected to the conveyor chain.
Figure 2:
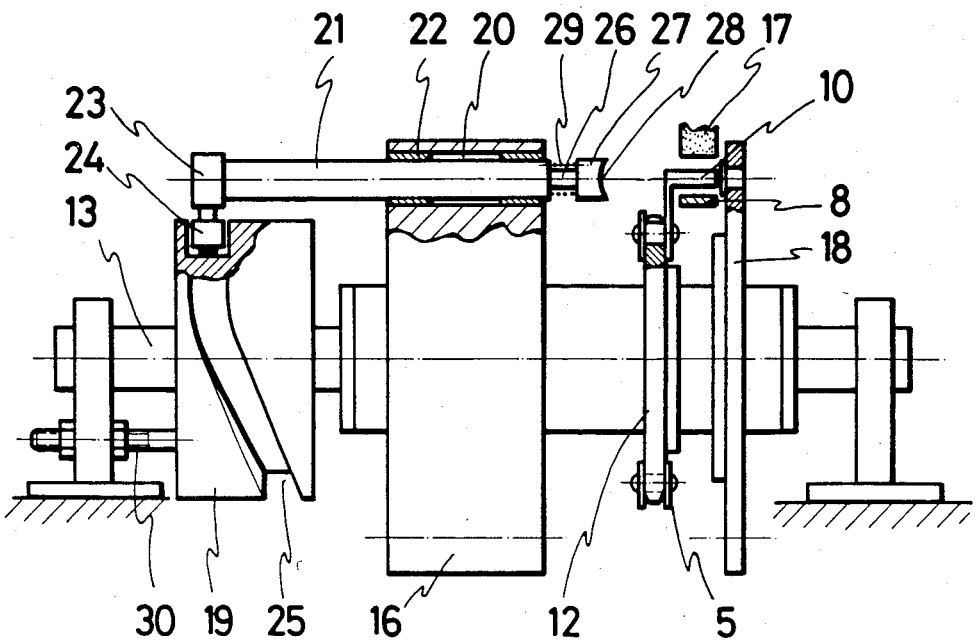
FIG. 2 shows a front elevation view of the sizing drum, which appears partially sectioned, clearly showing its structure.

In the light of these figures, it can be seen how the fruit selecting machine which the invention proposes, on a bedframe which has not been shown, as it is completely irrelevant to the essence of the invention, in which a feed hopper 1 of the fruit is arranged, in this case of olives 2, said hopper including a rotating plate 3 in its base, with holes 4 in its periphery, in which the fruit, e.g. the olives are placed so that they fall individually on a drag chain 5, as the holes 4 successively and operatively come opposite an outlet hole 6 made in the closed base of the hopper.

More specifically, the drag chain 5 is placed immediately below a fixed rolling track 8, on which the fruit or olives 2 really fall, the latter being dragged through pushers 9 connected to the chain 5 which exceed the rolling track 8 on one of its sides and which have a transversal arm 10 which constitutes the actual pusher of the fruit 2, as can clearly be seen in the enlarged detail in FIG. 1A.

The chain 5 establishes a closed cycle on two toothed wheels 11 and 12, the latter integrally joined to the shaft 13 of the sizing drum, which will be disclosed further on, and a tightening pinion 14 assisting the toothed wheels 11 and 12.

A first rubber brush 15 is placed on the rolling track 8 which gently touches the top of the fruit, to assist positioning it correctly, while in the top of the aforementioned sizing drum 16, mounted on the shaft 13, a second brush 17 is placed, which also ensures the correct position of the olive or fruit concerned, to be precise, in this case, at the specific moment the sizing of the fruit is about to take place.

For this sizing, a plate 18 and a cam 19 are mounted, apart from the actual drum 16 and the toothed wheel 12 corresponding to the drag chain 5.

On the other hand, within the drum 16 as such, and specifically forming a perimetrical alignment, a plurality of holes 20 are made, parallel to its axis, in which respective retractile shanks 21 move, through bearings 22, said shanks 21 being driven by the cam 19 for which in their corresponding end they have an elbow 23, finished in a pulley wheel 24, which moves in the channel 25 formed on the cam 19 for the latter to act as such.

At their opposite end, the retractile shanks 21 face the plate 18.

More specifically, these shanks 21 are made of a hollow cylinder, which corresponds to reference number 21, inside which a rod 26 moves, finished in a head 27, with its curved front 28 concave, corresponding to the fruit, a spring 29 being fixed between the head 27 and the inlet of the hollow cylinder 21; after the front 28 has touched the fruit, the said spring 29 enables the rod 26 to withdraw, against its slight tension, avoiding the fruit being damaged.

On the other hand, the cam 19 is mounted on the shaft 13, with the possibility of being adjusted, for which there are tensioning devices 30 connected to the bedframe or fixed structure of the machine. Through the correct positioning of the cam 19, the spacing level A between the front 28 of the retractile shanks and the plate 18 can be set as wished, in the closest position between the said elements, defined by the respective sector of the channel 25 of the cam 19.

Figure 3:
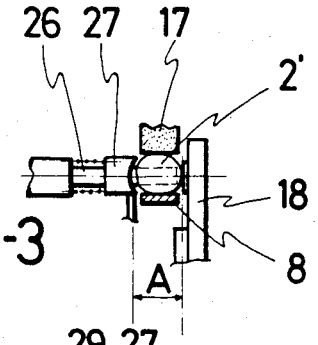
FIG. 3 shows a detail, also in a front elevation view, of the clip formed between the retractile shank and the plate for fixing the fruit, if necessary, in the specific case in which the fruit does not reach the predetermined size, and remains free between the said elements.
Figure 4:
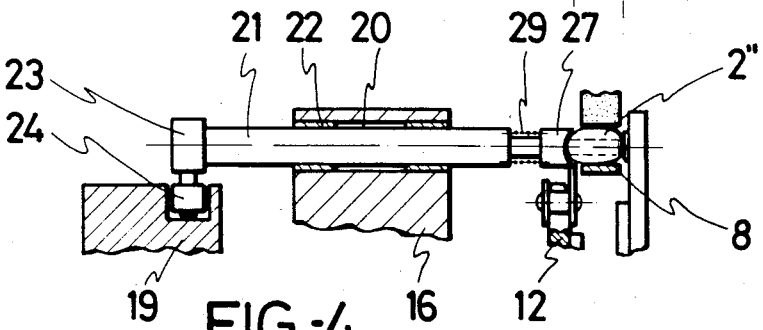
FIG. 4 shows a similar detail to the previous figure, corresponding in this case to fruit which exceeds the minimum pre-established size; in this case, the drum as such has also been illustrated partially and sectioned, and the drive cam of the shank.

According to the layout disclosed and once the size A has been established, corresponding to the selection, it is obvious that the fruit, dragged by the transversal arms 10 connected to the chain, on the rolling track 8, reaches the sizing drum in the top end area, as can be seen in FIG. 1, and at this moment, the projection of the retractile shank 21 is produced until the limit situation shown in FIGS. 3 and 4. If the fruit does not reach the pre-determined selection size, as occurs in FIG. 3, where the said fruit is marked as 2', the clip placed between the head 27 of the retractile shank and the disc 18 is inoperative, which means that the fruit 2' is released and since the drum continues to turn, it leaves the latter by simple centrifugal force, as can be seen in FIG. 1, where it appears with the same reference 2', to reach a removal outlet 31 towards the respective collector tank for fruit which does not reach the prefixed dimensions.

Conversely, when the fruit 2'' exceeds the aforementioned size A, as happens in FIG. 4, it is trapped between the head 27 and the drum 18, without being damaged, as the said head withdraws, according to the size of the fruit, against the tension of the spring 29 and this gripping effect of the fruit is maintained during a given partial turn, established by the sector of the channel 25 of the cam 19, in which said channel is parallel to its inner face, specifically until a situation in which the fruit has passed the previous vessel 31 to a considerable extent, from where it falls into a second vessel 32, which takes the fruit to a collector tank for that which reaches and exceeds the minimum predetermined size.

In this way, from a mass of olives or any other fruit, whose dimensions vary greatly, we are able to select this fruit, establishing two independent groups, one size above and the other below a pre-established level, said limit level separating both groups, also being able to be adjusted as wished, by merely operating the cam correctly, regulating their relative position in the general context of the sizing drum.

It is not considered necessary to make this description any more lengthy for an expert on the subject to understand the scope of the invention, and the advantages derived therefrom.

The materials, shape, size and layout of the elements will be liable to variation, provided this does not involve altering the basic essence of the invention.

The terms in which this Specification has been drawn up should always be taken in their broadest and unlimiting sense.

We claim:

1. A machine for sizing an input stream of fruit such as olives into at least two separate output streams, comprising:

an endless conveyor entrained about longitudinally spaced, transversally extending wheel means, including an upstream wheel means and a downstream wheel means, so as to have a carrying run and a return run; said conveyor having a plurality of longitudinally spaced pushers mounted thereto, each such pusher being adapted to accept a single fruit to be sized and to push that fruit along said carrying run;

a hopper associated with said carrying run of said conveyor towards an upstream end of such run, this hopper being adapted to receive a plurality of fruit to be sized; and to supply such fruit individually to said conveyor so that each fruit is pushed by a respective said pusher;

a sizing means associated with said downstream wheel means and adapted to rotate coaxially therewith, this sizing means including a plate means disposed laterally to one side of said endless conveyor, and a drum means disposed laterally to the opposite side of said endless conveyor; a plurality of shank means mounted to said drum means for reciprocal movement towards and away from said plate means; each said shank means being provided with a head which spacedly confronts said plate means; a relatively stationary cam channel-providing member having a cam channel provided therein; each said shank having a cam follower connected therewith and received in said cam channel; said cam channel being configured to have at least two shank head position-controlling segments, in one of which each shank head in succession is brought to a predetermined magnitude of proximity to said plate means as that shank head is rotated together with said downstream wheel means until said downstream wheel means has passed an undersized fruit unloading station located rotationally past top dead center of said drum means, and in a succeeding another one of which each shank head in succession is withdrawn to a position of greater spacing from said plate means as that shank head is rotated together with said downstream wheel means through an oversized fruit unloading station;

each said shank head being adapted to be so aligned axially of said wheel with a respective said pusher as to engage, in use, the respective fruit being pushed by that pusher with sufficient compressive force to trap that fruit against said plate means only so long as said cam follower of the respective said shank is disposed in said one shank head position-controlling segment and only if that fruit is at least equal in linear dimension laterally of said conveyor to a predetermined linear dimension, whereby undersized fruit do not become trapped by said shank heads against said plate means and fall from said conveyor at said undersized fruit unloading station, whereas oversized fruit do become so trapped and are conveyed by said conveyor past said undersized fruit unloading station until said shanks are withdrawn and said oversized fruit fall from said conveyor at said oversized fruit unloading station.

2. The fruit sizing machine of claim 1, wherein:

said drum means includes a drum mounted to a mounting shaft for said downstream wheel means; means defining a plurality of angularly spaced openings formed axially through said drum, these openings being arranged in a circle coaxially about said shaft;

each said shank being received in a respective one of said openings and journalled for reciprocation therein;

each said shank head being resiliently mounted to the respective said shank for accomodating temporary, limited retraction of each said shank head away from said plate means due to compressive contact with an oversized fruit.

3. The fruit sizing machine of claim 2, wherein:

each said shank is hollow and has an open end;

each said shank head is mounted to a rod which is telescopically received in the respective said hollow shank through the respective said open end; and a spring resiliently mounts each said shank head to the respective said shank.

4. The fruit sizing machine of claim 1, further including a stationary base, said cam channel-providing member being adjustably mounted to said base for adjustment towards and away from said plate means for adjusting said predetermined magnitude of proximity of said shank heads to said plate means.

5. The fruit sizing machine of claim 1, wherein:

said endless conveyor in said carrying run is underlaid by a fixed track on which the fruit are slid by said pushers.

6. The fruit sizing machine of claim 5, wherein:

said conveyor is an endless chain-type conveyor having said pushers connected therewith, and said wheel means are toothed wheels about which said conveyor chain is entrained.

7. The fruit sizing machine of claim 6, wherein:

said fixed track inclines from said hopper to said drum means; and said hopper includes a hopper body having sidewalls and an inclined bottom wall; a rotary plate disposed in said hopper body in a plane adjacent said bottom wall and arranged to be rotated relative to said hopper body; means defining a relatively elevated opening through said hopper body bottom wall over said conveyor; and means defining a plurality of holes through said rotary plate, these holes being arranged to acquire individual fruit from said hopper and to be brought successively into registry with said opening through said hopper body bottom wall as said rotary plate is rotated, whereby individual fruit in said hopper are successively fed by rotation of said rotary plate through said opening and thus onto said conveyor.

8. The fruit sizing machine of claim 1, further including:

means for orienting oblong fruit crosswise of said conveyor by contact with said fruit after said fruit has begun to be conveyed by said conveyor and before said fruit is subjected to clamping between said plate means and the respective ones of said shank heads, whereby said machine is adapted to size oblong fruit such as olives.

* * * * *